US005899324A

United States Patent [19]

Stone et al.

[11] Patent Number: 5,899,324

[45] Date of Patent: May 4, 1999

[54] FORWARD-TILTING DISPLAY CONTAINER WITH FOLD-OUT DOORS

[75] Inventors: James L. Stone, Grand Rapids, Mich.; Timothy J. Lewandowski, Oak Park, Ill.

[73] Assignee: Tenneco Packaging, Evanston, Ill.

[21] Appl. No.: 08/870,409

[22] Filed: Jun. 6, 1997

[51] Int. Cl.[6] ..... B65D 5/52

[52] U.S. Cl. ..... 206/45.21; 206/45.23

[58] Field of Search ..... 206/45.2, 45.21, 206/45.23, 459.5; 229/131, 145; 40/312, 313

[56] References Cited

U.S. PATENT DOCUMENTS

| | | | |
|---|---|---|---|
| 939,234 | 11/1909 | Eichhorn | 206/45.23 |
| 1,103,708 | 7/1914 | Thumb . | |
| 1,125,987 | 1/1915 | Eichhorn | 206/45.21 |
| 1,179,985 | 4/1916 | Wallace | 206/459.5 X |
| 1,418,798 | 6/1922 | Hirschl | 206/45.21 |
| 1,685,606 | 9/1928 | Leopold | 206/45.21 |
| 1,860,309 | 5/1932 | Davidson | 206/45.21 |
| 2,005,816 | 6/1935 | Weiss | 206/45.21 |
| 2,140,000 | 12/1938 | Darragh | 206/45.2 |
| 2,248,547 | 7/1941 | Osteen | 206/45.21 |
| 2,294,965 | 9/1942 | Davidson | 206/45.21 |
| 2,513,079 | 6/1950 | Buerger . | |
| 2,700,456 | 1/1955 | Gillam . | |
| 2,927,720 | 3/1960 | Adams . | |
| 2,990,099 | 6/1961 | Ryder . | |
| 3,206,098 | 9/1965 | Stenger . | |
| 3,690,543 | 9/1972 | Zeitter . | |
| 3,870,221 | 3/1975 | Zeitter . | |

FOREIGN PATENT DOCUMENTS

| | | | |
|---|---|---|---|
| 101169 | 8/1916 | United Kingdom | 206/45.21 |

*Primary Examiner*—Bryon P. Gehman
*Attorney, Agent, or Firm*—Arnold White & Durkee

[57] ABSTRACT

A forward-tilting display container with fold-out display doors which is adjustable between an enclosed position and a display position. In the enclosed position, the fold-out display doors comprise a portion of the lid of the container, with the remainder of the lid defining a pedestal-forming portion. The lid is hingedly connected to a display panel on the side of the container. The container is adjusted to the display position by folding the lid back so that the display doors overlay the display panel and the pedestal-forming portion lies underneath the container. In the display position, the display doors are opened to expose both the display panel and the display doors, with the pedestal-forming portion of the lid supporting the container in a forward-tilting position.

15 Claims, 5 Drawing Sheets

FORWARD-TILTING DISPLAY CONTAINER WITH FOLD-OUT DOORS

FIELD OF THE INVENTION

The present invention relates generally to the field of paperboard folding containers used to display products and, more particularly, to a paperboard display container which tilts forward and includes fold-out doors.

BACKGROUND OF THE INVENTION

It has long been known that containers may be simply and economically manufactured from a "blank", or flat sheet of paperboard, which is folded and glued to form a completed paperboard container. Such paperboard folding containers may be used in a variety of applications including storage, shipping and display of products such as candy, office supplies, small toys, and the like. Typically, the containers are packed with several of such items by the manufacturer, then sealed and shipped to various merchants for resale. Where the items are sold individually, it is a common practice among merchants to simply open the container and place the opened container on their store shelves, thus displaying the contents to the consumer and allowing the consumer to remove individual items from the container for purchase.

A graphic display on the face of the container is typically used to convey information about the product to the consumer. For example, the graphic display may indicate the trademark, price or other characteristic of the product. The graphic display may also be used to capture the attention of the consumer through any combination of colors, patterns, symbols, pictures, photographs and the like. It is well known that attractive eye-catching displays can result in increased sales of a product. Accordingly, especially where containers of one product are positioned adjacent to competitors products on the store shelves, there is a need to further enhance the visual impact that such containers and associated graphic displays have on the typical consumer. The present invention is directed to addressing this need.

SUMMARY OF THE INVENTION

In accordance with one aspect of the present invention, there is provided a display container comprising a base and a lid adjustable between an enclosed position and a display position. The base of the container includes a bottom and a plurality of sides, one of the sides comprising a display panel adapted to contain a graphics display. The lid is hingedly connected to the display panel and includes a door-forming portion and a pedestal-forming portion. The door-forming portion includes a pair of hinged door panels each having a display surface adapted to contain a graphics display. The pedestal-forming portion includes a pair of angled top side panels. When the container is in the enclosed position, the lid is positioned on top of the base. When the container is in the display position, the lid is folded back relative to the base such that the door-forming portion overlies the display panel and the pedestal-forming portion lies underneath the base, supporting the container in a forward-tilting position. The door panels open to expose both the display panel and their display surfaces.

The door-forming portion of the above-described container is defined generally between a first and second score line, the first score line hingedly connecting the lid of the container to the display panel. A pair of vertical score lines extend between the first and second score lines to define hinges of the respective door panels; an upper and lower knife cut define respective upper and lower edges of the door panels; and a dividing knife cut defines the outer edges of the door panels. The dividing knife cut is positioned generally intermediate the pair of vertical score lines and spans between the first and second score lines. When the container is in the enclosed position, the hinged door panels generally meet at the dividing knife cut. When the container is adjusted to the display position, the hinged door panels break apart from each other at the dividing knife cut.

In accordance with another aspect of the present invention, there is provided a pair of door extension tabs for enhancing the visual impact of the doors when the container is in the display position. The door extension tabs each define a projection hingedly connected to one of the door panels. When the container is in the enclosed position, the door extension tabs detachably extend into the display panel. When the container is adjusted to the display position, the door extension tabs detach from the display panel and project above the door panels, effectively increasing the height of the door panels while simultaneously cutting down the height of the display panel to facilitate access to the product inside the container.

In accordance with still another aspect of the present invention, there is provided a pair of locking feet for holding the door panels open when the container is in the display position. The locking feet each define a projection hingedly connected to a respective one of the door panels and to the pedestal-forming portion of the container. When the container is adjusted to the display position, the locking feet fold under the base of the container so as to hold the door panels open.

In accordance with a further aspect of the present invention, there is provided a lower display tab defining a projection hingedly connected to the lower edge of the display panel. When the container is in the enclosed position, the lower display tab detachably extends into a portion of the bottom of the container. When the container is adjusted to the display position, the lower display tab detaches from the bottom of the container and folds forward through the opened door panels to provide a face-up display complementary to the display doors and display panel.

BRIEF DESCRIPTION OF THE DRAWINGS

The foregoing and other advantages of the invention will become apparent upon reading the following detailed description and upon reference to the drawings in which.

Figure 1:
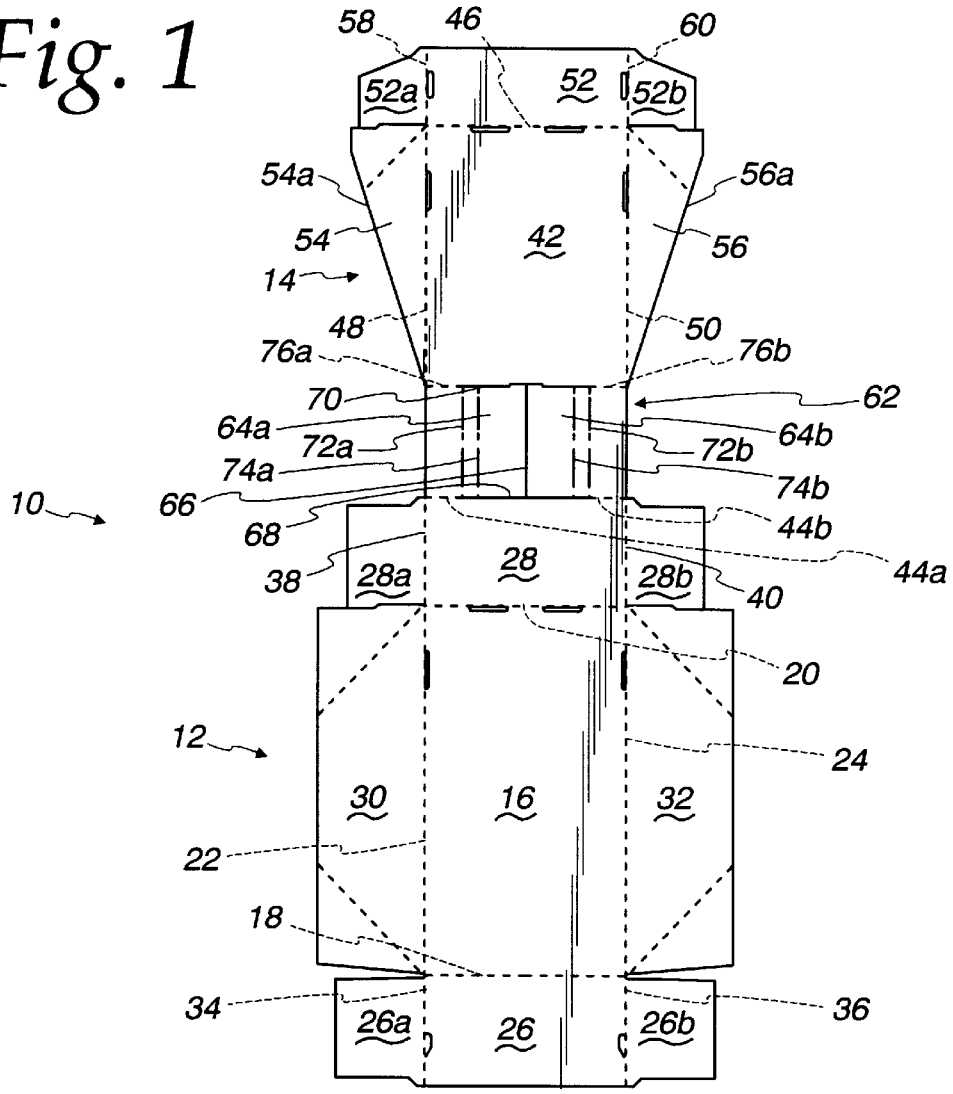
FIG. 1 is a top plan view of an inside surface of a blank used to form a forward-tilting display container with fold-out doors according to one embodiment of the invention.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives failing within the spirit and scope of the invention as defined by the appended claims.

DESCRIPTION OF SPECIFIC EMBODIMENTS

Turning now to the drawings and referring initially to FIG. 1, a blank from which a forward-tilting display container having fold-out doors may be manufactured according to one embodiment of the invention is illustrated and generally designated by reference numeral 10. In general, the blank 10 is comprised of a unitary piece of paperboard material and includes a base-forming portion 12 and a lid-forming portion 14. The base-forming portion 12 is comprised of a base panel 16 hingedly connected along score lines 18, 20, 22, 24 to respective bottom side panels 26, 28, 30, 32. Bottom side panel 26 is hingedly connected along score lines 34, 36 to respective bottom side flaps 26*a* and 26*b*, and bottom side panel 28 is hingedly connected along score lines 38, 40 to respective bottom side flaps 28*a* and 28*b*. The lid-forming portion 14 of the container is comprised of a lid panel 42 hingedly connected along score lines 44*a* and 44*b* to bottom side panel 28 and hingedly connected along score lines 46, 48, 50 to respective top side panels 52, 54, 56. Top side panel 52 is hingedly connected along score lines 58, 60 to top side flaps 52*a* and 52*b*.

A door-forming portion 62 of the lid panel 42 is comprised of two door panels 64*a*, 64*b* separated from each other by a dividing knife cut 66 and bounded by an upper knife cut 68 and a lower knife cut 70. Upper knife cut 68 is generally colinear with score lines 44*a*, 44*b* formed on either side of upper knife cut 68. Similarly, lower knife cut 70 is generally colinear with score lines 76*a*, 76*b* formed on either side of lower knife cut 70. Door panels 64*a*, 64*b* are further defined by respective vertical score line 72*a*, 72*b*, each of which are generally perpendicular to dividing knife cut 66 and are adapted to serve as hinges to enable opening and closing of door panels 64*a*, 64*b*, as will be described in relation to FIGS. 2 through 4. The upper and lower knife cuts 68, 70 span entirely between the vertical score lines 72*a,b*. In the illustrated embodiment, dividing knife cut 66 is linear, both centered between and perpendicular to vertical score lines 72*a*, 72*b*. Alternatively, however, dividing knife cut 66 may be non-linear, non-centered and/or non-perpendicular to vertical scores 72*a*, 72*b*.

Typically, the inner surface of door panels 64*a*, 64*b* is unprinted and the outer surface is printed with a graphics display. As will be described in relation to FIG. 3, the lid panel 42 is adapted to be folded 180° relative to side panel 28 along score lines 44*a, b* so that the door-forming portion 62 of the lid panel 42 lies adjacent to side panel 28, and the remainder of the lid panel 42 is adapted to be folded perpendicular to the door-forming portion 62 along score lines 76*a*, 76*b* so that it lies underneath the base-forming portion 12 of the container.

The base-forming portion 12 may be made to form the base of the container by folding bottom side flaps 26*a*, 26*b* upward along respective score lines 34, 36 to a position approximately perpendicular to the bottom side panel 26 and folding bottom side panel 26 upward along score line 18 to a position approximately perpendicular to the base panel 16. Similarly, bottom side flaps 28*a*, 28*b* are folded upward along respective score lines 38, 40 to a position approximately perpendicular to bottom side panel 28 and bottom side panel 28 is folded upward along score line 20 to a position approximately perpendicular to the base panel 16. Thereafter, bottom side panel 30 is folded upward along score line 22 and adhered to bottom side flaps 26*a*, 28*a*, and bottom side panel 32 is folded upward along score line 24 and adhered to bottom side flaps 26*b*, 28*b*. It will be appreciated, however, that the order and manner in which the folding steps are performed may be varied according to the level of skill in the art.

Similarly, the lid-forming portion 14 may be made to form the lid of the container by folding top side flaps 52*a*, 52*b* upward along score lines 58, 60 to a position approximately perpendicular to the top side panel 52 and folding top side panel 52 upward along score line 46 to a position approximately perpendicular to lid panel 42. Then, top side panels 54, 56 are folded upward along respective score lines 48, 50 and adhered to respective top side flaps 52*a*, 52*b*. The top side panels 54, 56 include respective angled edges 54*a*, 56*a* which serve to tilt the container forward when the lid is folded under the base of the container, as will be described in relation to FIG. 3. It will be appreciated that the order and manner in which the folding steps are performed to form the lid of the container may be varied according to the level of skill in the art. After forming the lid of the container, the container may be enclosed by folding the lid of the container along score lines 44*a,b* to a position atop the base of the container.

Figure 2:
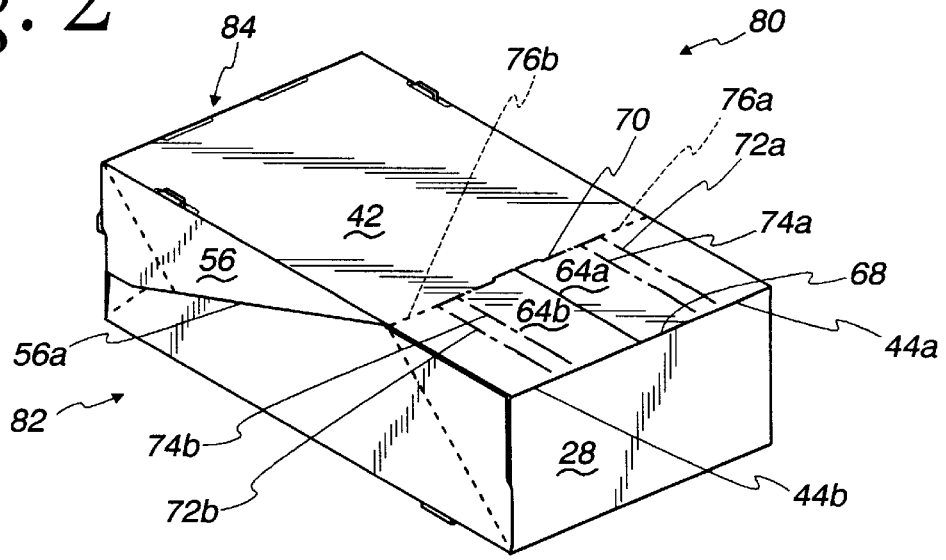
FIG. 2 is an isometric view of the container formed from the blank of FIG. 1 with the lid on top of the base.

FIG. 2 illustrates the container formed from the blank of FIG. 1, generally designated by reference numeral 80. The base of container 80, formed from the base-forming portion 12 of FIG. 1, is designated by reference numeral 82. Similarly, the lid of container 80, formed from the lid-forming portion 14 of FIG. 1, is designated by reference numeral 84. The lid 84 is hingedly connected to the bottom side panel 28 along score lines 44*a, b,* formed on either side of knife cut 68. The door-forming portion 62 of the lid 84 is defined on one side by score lines 44*a*, 44*b* and knife cut 68 and on another side by score lines 76*a*, 76*b* and knife cut 70. The portion of the lid 84 extending beyond the second score line is designated as a pedestal-forming portion of the lid 84.

As shown in FIG. 2, the container 80 is in an enclosed position, with the lid 84 positioned on top of the base 82 so as to enclose the container, such as it may appear after it has been filled with a product, closed and shipped to a merchant for sale of the individual items within the container. Typically, a graphic display including product information or advertising is printed on the side of the container formed from bottom side panel 28, hereinafter designated "graphics panel" 28.

Figure 3:
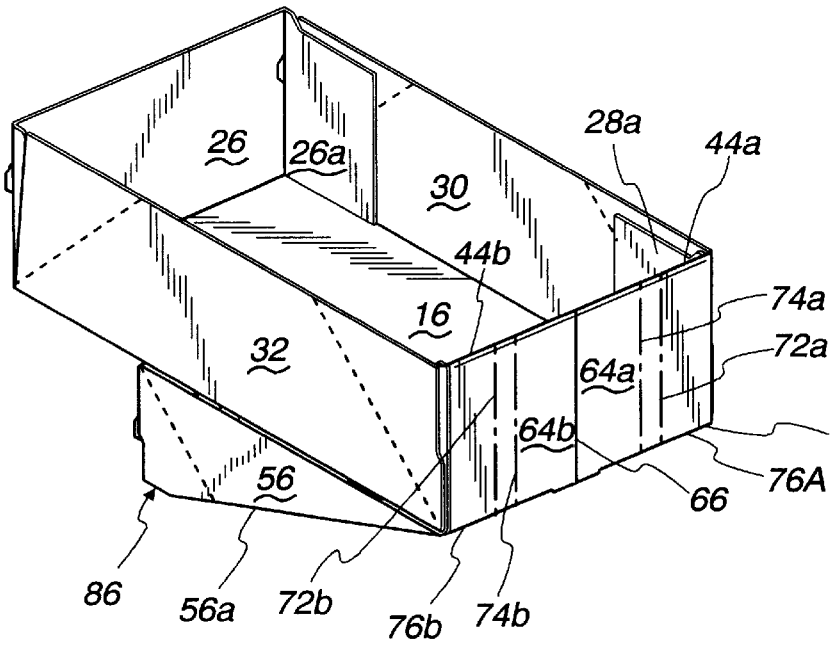
FIG. 3 is an isometric view depicting the container of FIG. 2 with the lid folded under the base.
Figure 4:
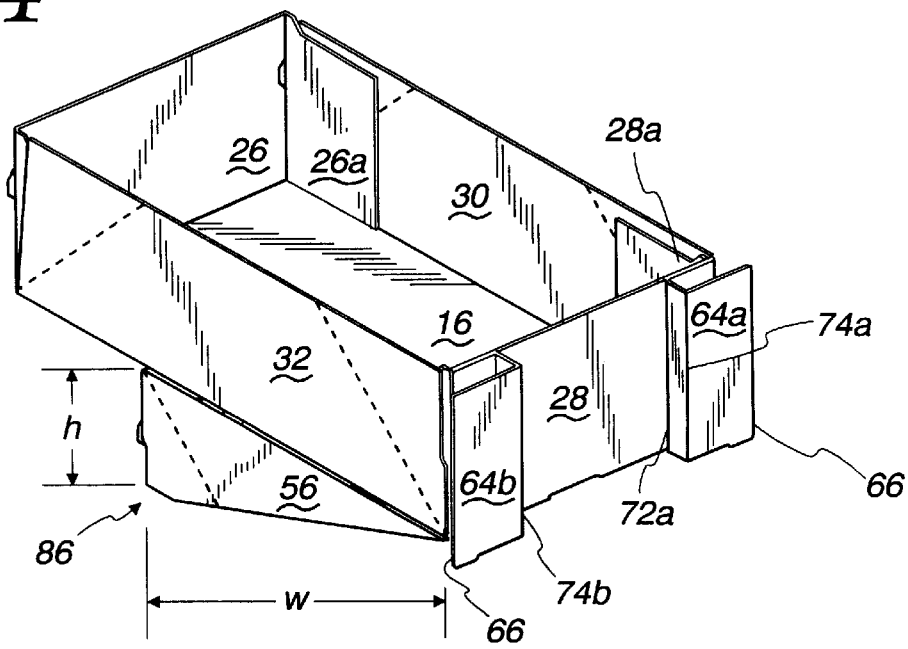
FIG. 4 is an isometric view depicting the container of FIG. 2 with the lid folded under the base and the display doors opened.

In accordance with principles of the present invention, the container 80 is adapted to adjust from the enclosed position (FIG. 2) to a display position (FIG. 4). This is accomplished by lifting the lid 84 upwardly from the base 82 and pivoting the lid around score line 44*a,b* and over the graphics panel 28 such that the display doors 64*a*, 64*b* lie over the graphics panel 28. The display doors 64*a*, 64*b* may be either opened or closed when performing this folding step. If the display doors 64*a*, 64*b* are closed after completion of this folding step, as shown in FIG. 3, the graphics panel 28 is obscured by the display doors 64*a*, 64*b*, with the inner, unprinted surface of the display doors 64*a*, 64*b* facing outward. Next, the remainder of the lid 84 is folded down and under the base 82 along score lines 76*a*, 76*b*, causing the base 82 to be supported upon a pedestal 86 formed from the pedestal-forming portion of the lid 84. In the embodiment depicted in FIG. 3, the pedestal 86 is wedge-shaped, defined by the angled edges 54*a*, 56*a* of the pedestal-forming portion of the lid 84. The wedge-shaped pedestal 86 tilts the open container forward, providing visibility and easy access to the products (not shown) inside the container. The angle of tilt ($\theta$) of the pedestal 86 is determined by the severity of slope of the angled edges 54*a*, 56*b* or more precisely, by the mathematical equation $\theta=\tan^{-1}(h/l)$, where h and l respectively define the height and length of the pedestal 86.

FIG. 4 shows the container 80 in its display position, with the display doors 64*a*, 64*b* opened to expose the graphics panel 28. The display doors 64*a*, 64*b* are designed to be separated from one another along dividing knife cut 66, then opened and held to a desired position by folding them back outwardly from the graphics panel 28 along respective vertical score lines 72*a*, 72*b* and/or 74*a*, 74*b*. Score lines 72*a*, 72*b* hingedly connect the respective display doors 64*a*, 64*b* to the graphics panel 28, and score lines 74*a*, 74*b* are provided to effect a convenient hold-open curvature for the respective display doors 64*a*, 64*b*. Alternatively, opening of the display doors 64*a*, 64*b* may be accomplished by folding them inwardly toward the interior of the container 80 at any point before the lid is folded over the graphics panel 28. In either case, opening of the display doors 64*a*, 64*b* exposes both the outer, printed surface of the display doors 64*a*, 64*b* and the graphics panel 28, thereby forming a three-dimensional graphic display designed to produce a powerful impact on the consumer. In the illustrated embodiment, the three-dimensional graphic display is utilized in combination with the forward tilt of the container 80 to further enhance the visual impact of the container. However, it will be appreciated that the container 80 may include display doors without the forward-tilting pedestal, or vice versa, depending on the needs of the user.

A variety of additions and/or modifications may be made to the display container heretofore described such as, for example, the provision of locking mechanisms for the display doors or modification of the container to create even more dynamic three-dimensional graphics. Three of such alternative embodiments will be described in relation to FIGS. 5–10. Because each of these alternative embodiments share several common elements and features with the embodiment heretofore described, like reference numerals will be employed.

Figure 5:
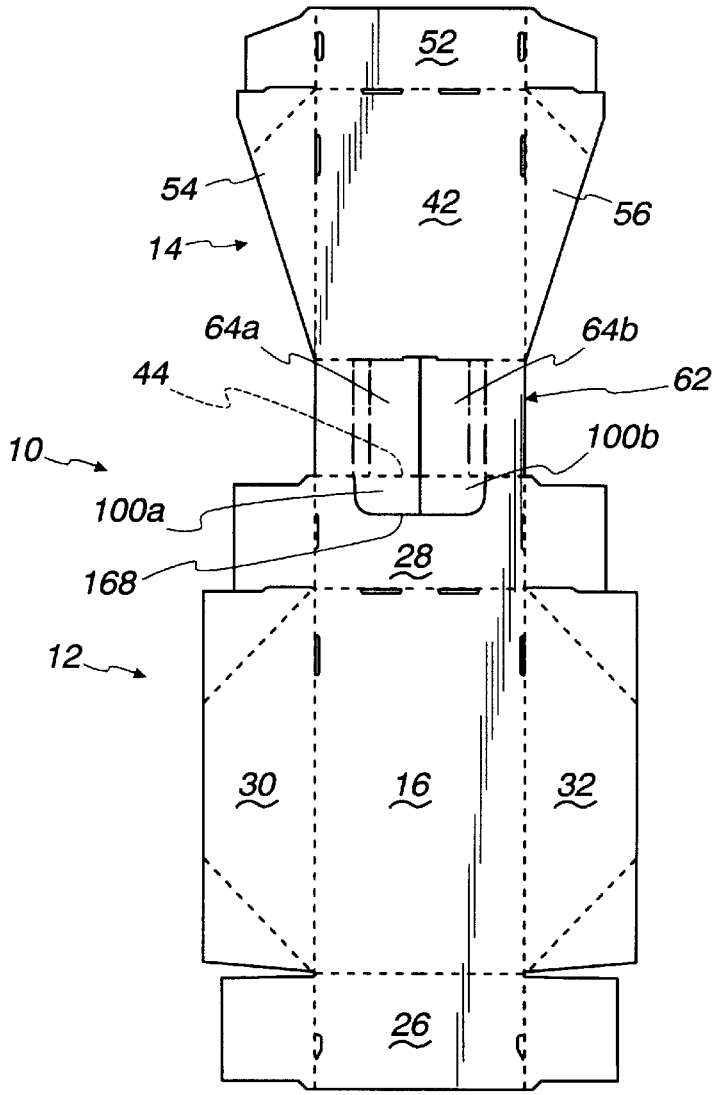
FIG. 5 is a top plan view of an inside surface of a blank used to form a forward-tilting display container with fold-out doors according to another embodiment of the invention.

FIG. 5 portrays a blank 10 from which a forward-tilting display container having fold-out doors may be manufactured according to a first alternative embodiment of the invention. The blank 10 is comprised of a base-forming portion 12 and a lid-forming portion 14, each being substantially similar to the respective base- and lid-forming portions described in relation to FIGS. 1–4. The door-forming portion 62 has nevertheless been modified from the embodiment shown in FIGS. 1–4. More specifically, in the embodiment shown in FIG. 5, the upper edges of the two door panels 64*a*, 64*b* are defined by a curved knife cut 168 extending part-way into graphics panel 28. The curved knife cut 168 defines two respective door extension tabs 100*a*, 100*b* hingedly connected to the respective door panels 64*a*, 64*b* by score line 44.

Figure 6:
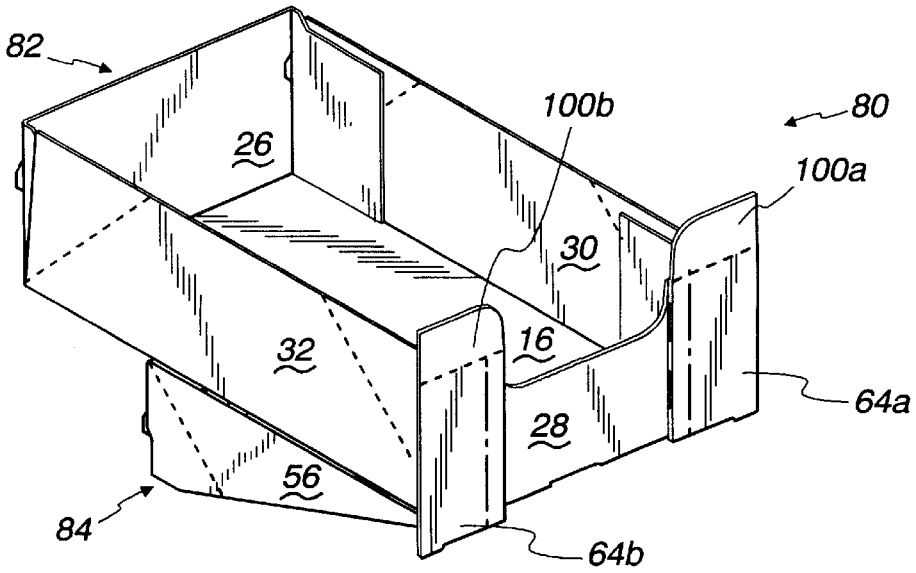
FIG. 6 is an isometric view depicting a container formed the blank of FIG. 5 with the lid folded under the base and the display doors opened.

FIG. 6 shows the blank 10 of FIG. 5 after it has been folded to form a forward-tilting container 80 with display doors in the manner heretofore described. As can be seen in FIG. 6, the door extension tabs 100*a*, 100*b* become detached from the side panel 28 as the lid 84 is folded under the base and extend above the respective door panels 64*a*, 64*b* so as to effectively increase the height of the door panels 64*a*, 64*b*, thus creating an even more striking visual impact on the consumer than the embodiment shown in FIG. 4. At the same time, the removal of door extension tabs 100*a*, 100*b* from the graphics panel 28 effectively cuts down (i.e., lowers the top edge of) graphics panel 28, thus providing even better visibility and easier access to the products inside the container 80.

Figure 7:
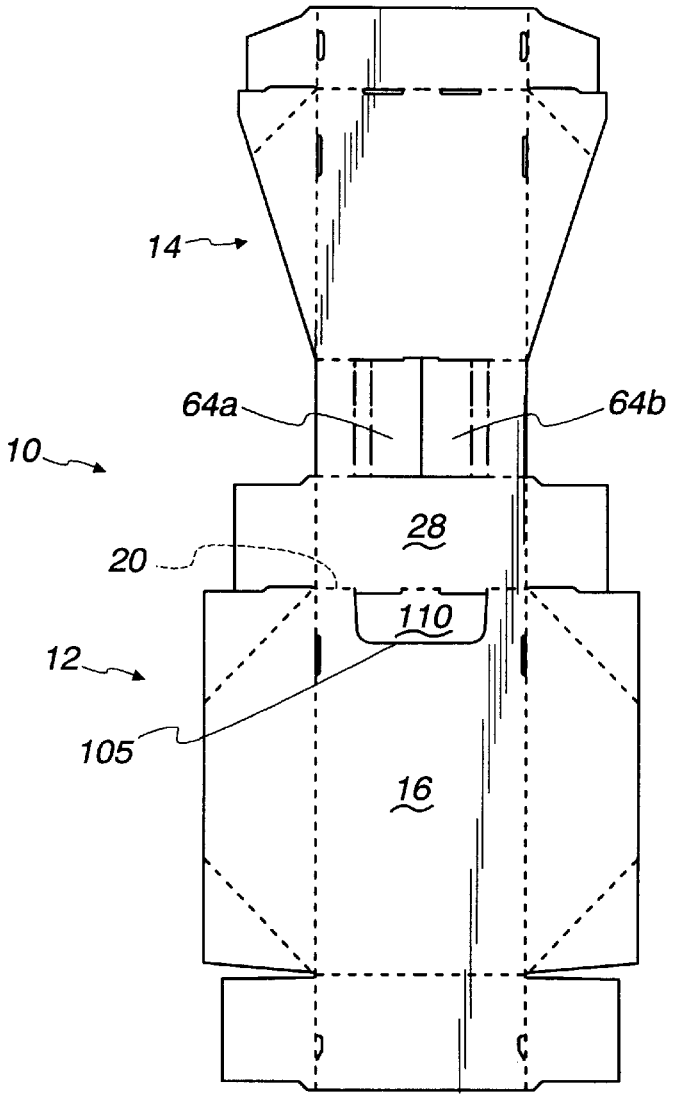
FIG. 7 is a top plan view of an inside surface of a blank used to form a forward-tilting display container with fold-out doors according to yet another embodiment of the invention.
Figure 8:
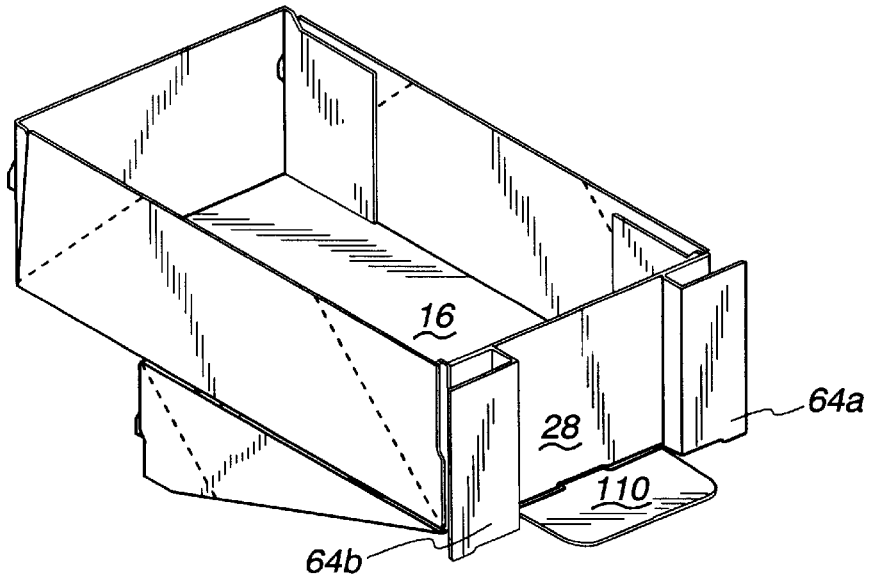
FIG. 8 is an isometric view depicting a container formed from the blank of FIG. 7 with the lid folded under the base and the display doors opened.

FIG. 7 portrays a blank 10 from which a second alternative embodiment of a forward-tilting display container with fold-out doors may be manufactured. The blank 10 is comprised of a base-forming portion 12 and a lid-forming portion 14, each being substantially similar to the respective base- and lid-forming portions described in relation to FIGS. 1–4. In the embodiment shown in FIG. 7, however, there is provided a curved knife cut 105 extending from score line 20 into base panel 16 and defining a lower display tab 110. When the container is in the closed position, the lower display tab is detachably connected to the base panel 16. When the container 80 is opened to the display position (FIG. 8), the lower display tab 110 becomes detached from the base panel 16 and extends forward (printed side up) into a position underneath and between the two opened door panels 64*a*, 64*b*. The base tab 110 thereby serves as a face-up graphics display, in addition to the respective graphics displays on the graphics panel 28 and/or the display doors 64*a*, 64*b*.

Figure 9:
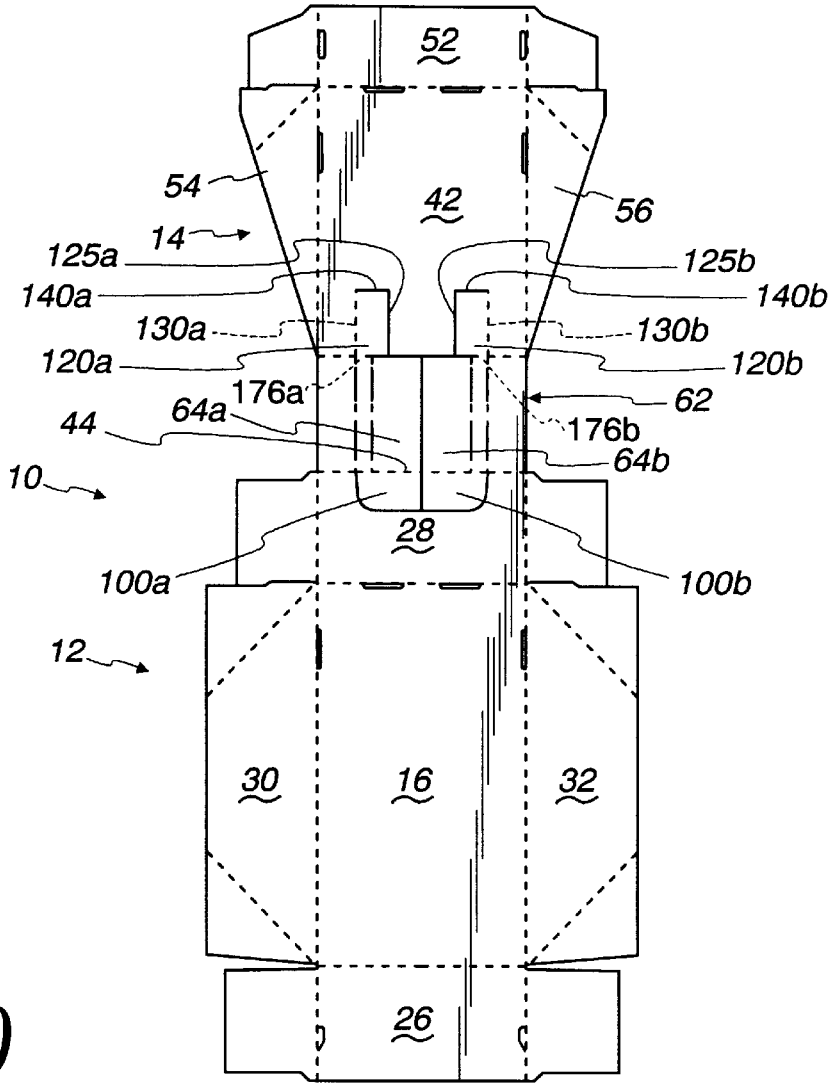
FIG. 9 is a top plan view of an inside surface of a blank used to form a forward-tilting display container with fold-out doors according to still yet another embodiment of the invention.
Figure 10:
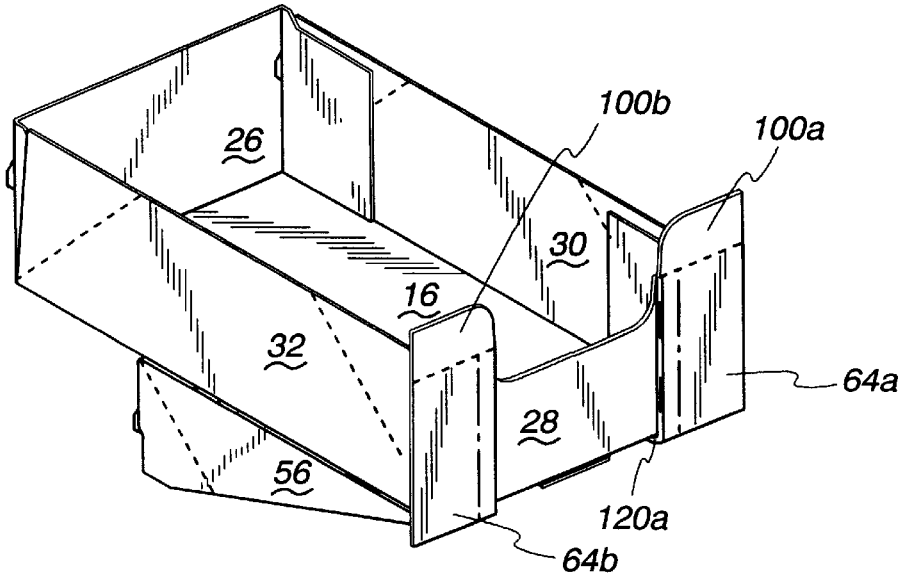
FIG. 10 is an isometric view depicting a container formed from the blank of FIG. 9 with the lid folded under the base and the display doors opened.

FIG. 9 portrays a blank 10 from which another embodiment of a forward-tilting display container with fold-out doors may be manufactured. The blank 10 is comprised of a base-forming portion 12 and a lid-forming portion 14, each being substantially similar to the respective base- and lid-forming portions described in relation to FIGS. 1–4. A pair of door extension tabs 100*a*, 100*b* are hingedly connected along score line 44 to upper edges of the door panels 64*a*, 64*b*, as described in relation to FIG. 5. The blank 10 further includes a pair of locking feet 120*a*, 120*b* hingedly connected along respective score lines 176*a*, 176*b* to lower edges of the respective door panels 64*a*, 64*b*. The locking feet 120*a*, 120*b* extend into the lid panel 42, bounded by respective vertical knife cuts 125*a*, 125*b*, vertical score lines 130*a*, 130*b* and horizontal knife cuts 140*a*, 140*b*.

In this embodiment, to adjust the container to the display position (FIG. 10), the display doors 64*a*, 64*b* are opened before the lid is folded over the graphics panel 28. More specifically, with the door-forming portion 62 extending upwardly from the graphics panel 28, the display doors 64*a*, 64*b* are folded inwardly along score lines 72*a*, 72*b* to a position approximately 180° from their initial position. The locking feet 120*a*, 120*b*, being connected to the display doors 64*a*, 64*b* along respective score lines 176*a*, 176*b*, are folded inwardly simultaneously with the display doors 64*a*, 64*b* along respective score lines 130*a*, 130*b*. Then, when the lid is folded over the graphics panel 28, the opened display doors 64*a*, 64*b* lie over the graphics panel and expose the displays on the graphics panel 28 and/or the outer surface of the display doors 64*a*, 64*b*. The locking feet (positioned under the container and not visible in FIG. 10), being connected both to the lid panel 42 and to the display doors 64*a*, 64*b*, thereby serve to lock the display doors 64*a*, 64*b* in an open position.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A display container adjustable between an enclosed position and a display position, said display container comprising:

a base panel hingedly connected to a plurality of bottom side panels, said base panel and said bottom side panels being folded relative to each other to form a base, one of said bottom side panels defining a display panel adapted to contain a graphics display; and a lid panel hingedly connected to said display panel along a first score line, said lid panel including a door-forming portion defined generally between said first score line and a second score line, said door-forming portion including a pair of hinged door panels each having a display surface adapted to contain a graphics display, a remaining portion of said lid panel being hingedly connected to a plurality of top side panels, said lid panel and said top side panels being folded relative to each other to form a lid;

wherein in said enclosed position, said lid is positioned on top of said base with said lid panel being generally perpendicular to said display panel, said door panels being closed when said container is in said enclosed position, wherein in said display position, said lid is folded back relative to said base along said first and second score lines such that said door-forming portion overlies said display panel and the remaining portion of said lid panel lies underneath said base panel, said door panels being opened to expose said display panel and their respective display surfaces when said container is in said display position.

2. A display container adjustable between an enclosed position and a display position, said display container comprising:

a base including a bottom and a plurality of sides, one of said sides including a display panel adapted to contain a graphics display;

a lid hingedly connected to said display panel and including a door-forming portion and a pedestal-forming portion, said door-forming portion including a pair of hinged door panels each having a display surface adapted to contain a graphics display, said pedestal-forming portion including a pair of opposing top side panels;

wherein said lid is positioned on top of said base when said container is in said enclosed position, and wherein said lid is folded back relative to said base such that said door-forming portion overlies said display panel and said pedestal-forming portion lies underneath said base when said container is in said display position, said door panels being opened to expose said display panel and their respective display surfaces when said container is in said display position.

3. The display container of claim 2 further comprising a pair of door extension tabs each defining a projection hingedly connected to a respective one of said door panels, said door extension tabs detachably extending into a portion of the display panel when said container is in said enclosed position, said door extension tabs being adapted to detach from said display panel and extend above said door panels to provide an enhanced display when said container is adjusted to said display position.

4. The display container of claim 2 further comprising a lower display tab defining a projection hingedly connected to the lower edge of said display panel, said lower display tab detachably extending into a portion of the bottom of said container when said container is in said enclosed position, said lower display tab being adapted to detach from said bottom and fold forward through said opened door panels to provide a face-up display when said container is adjusted to said display position.

5. The display container of claim 2 further comprising a pair of locking feet each defining a projection hingedly connected to a respective one of said door panels, said locking feet further being hingedly connected to the pedestal-forming portion of the container, wherein said locking feet are adapted to fold under said base and lock said door panels open when said container is adjusted to said display position.

6. The display container of claim 5 further comprising a pair of door extension tabs each defining a projection hingedly connected to a respective one of said door panels, said door extension tabs detachably extending into a portion of the display panel when said container is in said enclosed position, said door extension tabs being adapted to detach from said display panel and extend above said door panels to provide an enhanced display when said container is adjusted to said display position.

7. The display container of claim 2 wherein the container is composed of a unitary blank of paperboard material.

8. The display container of claim 2 wherein said opposing top side panels have respective angled edges, said angled edges causing said container to tilt forward when said container is in said display position.

9. The display container of claim 2 wherein said lid is hingedly connected to said display panel along a first score line, said door-forming portion being defined generally between said first score line and a second score line.

10. The display container of claim 9 wherein the door-forming portion includes a pair of vertical score lines extending between said first and second score lines and defining respective hinges of said pair of hinged door panels;

upper and lower knife cuts defining respective upper and lower edges of said hinged door panels; and a dividing knife cut positioned generally intermediate said pair of vertical score lines and spanning between said first and second score lines, said pair of hinged door panels generally meeting at said dividing knife cut when said container is in said enclosed position, said pair of hinged door panels being adapted to break apart from each other at said dividing knife cut when said container is adjusted to said display position.

11. The display container of claim 10 wherein said dividing knife cut is generally perpendicular to said first and second score lines.

12. The display container of claim 10 wherein said lower knife cut is generally colinear with said second score line.

13. The display container of claim 10 wherein said lower knife cut spans entirely between said pair of vertical score lines.

14. The display container of claim 10 wherein said upper knife cut is generally colinear with said first score line and spans entirely between said pair of vertical score lines.

15. The display container of claim 10 wherein said dividing knife cut is non-linear.

* * * * *